US012686895B2

(12) United States Patent
Negishi

(10) Patent No.: US 12,686,895 B2
(45) Date of Patent: Jul. 21, 2026

(54) METHOD FOR DESULFURIZING MOLTEN METAL

(71) Applicant: JFE STEEL CORPORATION, Tokyo (JP)

(72) Inventor: Hidemitsu Negishi, Tokyo (JP)

(73) Assignee: JFE STEEL CORPORATION, Tokyo (JP)

( * ) Notice: Subject to any disclaimer, the term of this patent is extended or adjusted under 35 U.S.C. 154(b) by 445 days.

(21) Appl. No.: 18/272,396

(22) PCT Filed: Dec. 8, 2021

(86) PCT No.: PCT/JP2021/045104
§ 371 (c)(1),
(2) Date: Jul. 14, 2023

(87) PCT Pub. No.: WO2022/172568
PCT Pub. Date: Aug. 18, 2022

(65) Prior Publication Data

US 2024/0076756 A1 Mar. 7, 2024

(30) Foreign Application Priority Data

Feb. 10, 2021 (JP) ..... 2021-019594

(51) Int. Cl.
*C21C 7/064* (2006.01)

(52) U.S. Cl.
CPC ..... *C21C 7/064* (2013.01)

(58) Field of Classification Search
CPC ..... C21C 7/064
USPC ..... 75/10.15
See application file for complete search history.

(56) References Cited

U.S. PATENT DOCUMENTS 3,953,308 A * 4/1976 Gatellier ..... C21C 7/064 204/245
2013/0125704 A1 5/2013 Wang et al.

FOREIGN PATENT DOCUMENTS

CN 102399937 A 4/2012
CN 102719617 A 10/2012
CN 103562415 A 2/2014
CN 111996330 A 11/2020
(Continued)

OTHER PUBLICATIONS

Tokuda; "Coupling Phenomena in Slag-Metal Reaction Systems;" Bulletin of the Japan Institute of Metals; 1976; pp. 379-385; vol. 15, Iss. 6.

(Continued)

*Primary Examiner* — Ricardo D Morales
(74) *Attorney, Agent, or Firm* — Oliff PLC

(57) ABSTRACT

A method for smelting cast iron, including loading charge materials, melting and introduction into the melt of vanadium, titanium and magnesium oxides and high-polymer waste compounds, characterized in that, simultaneously with the introduction of oxides and waste, the exhibit cathodic polarization of the cast iron melt at a constant current load, component 0.1-10 A/dm2 calculated on the surface of the melt mirror, while
As a counter electrode, a graphite electrode with an end area of up to 0.8 is used area of the melt mirror, which is under mechanical load and under electrical under tension, immerse in slag at a distance of 30-70 mm from the surface of the melt, with In this case, the ratio of cathode and anode current densities is 0.9-1.2.

2 Claims, 2 Drawing Sheets

(56) References Cited

FOREIGN PATENT DOCUMENTS

| | | | |
|---|---|---|---|
| JP | H04-9420 | A | 1/1992 |
| JP | H09-003515 | A | 1/1997 |
| JP | 2001-40406 | A | 2/2001 |
| JP | 2004-053590 | A | 2/2004 |
| JP | 2020-180319 | A | 11/2020 |
| KR | 10-2011-0073812 | A | 6/2011 |
| RU | 2084539 | C1 | 7/1997 |
| SU | 607843 | A1 | 5/1978 |
| WO | 2020/217828 | A1 | 10/2020 |

OTHER PUBLICATIONS

Sosinsky et al.; "The Composition and Temperature Dependence of the Sulfide Capacity of Metallurgical Slags;" Metallurgical Transactions B; 1986; pp. 331-337; vol. 17B.

Nakamura et al.; A New Development of the Optical Basicity; J-Japan Inst. Metals; 1986; pp. 456-461; vol. 50, No. 5.

Sep. 13, 2022 Office Action issued in Japanese Patent Application No. 2022-502954.

Oct. 28, 2022 Office Action issued in Taiwanese Patent Application No. 111104478.

Jan. 11, 2022 Search Report issued in International Patent Application No. PCT/JP2021/045104.

Jul. 23, 2025 Office Action issued in Chinese Patent Application No. 202180093330.8.

BY 15409 C1; Belarusian State Technological University; 2012.

Feb. 5, 2024 Decision of Grant issued in Russian Patent Application No. 2023121483.

Apr. 17, 2024 Extended Search Report issued in European Patent Application No. 21925812.6.

Sep. 14, 2024 Office Action issued in Korean Patent Application No. 10-2023-7026337.

* cited by examiner

METHOD FOR DESULFURIZING MOLTEN METAL

TECHNICAL FIELD

The present invention relates to a method for removing sulfur in molten metal charged in a reaction vessel, such as a ladle or a torpedo, through a reaction between the molten metal and slag added onto the molten metal.

BACKGROUND ART

In recent years, with upgrading of steel materials, there has been growing demand for higher yield ratios of ultra-low-sulfur steel and stricter [S]-standards for the sulfur content in steel. Thus, it is desired to reduce the sulfur concentration reached upon completion of processing and increase the speed of desulfurization process by improving molten iron desulfurization technology.

The desulfurization reaction is expressed by $[S]+(O^{2-})=(S^{2-})+[O]$ as an interfacial reaction between slag and molten iron. Here, [R] represents an element R being dissolved in molten iron, and (R) represents the form of the element R in slag. Conventionally, a reached concentration and a process time (reaching time) taken to reach the reached concentration have been obtained by a theory of equilibrium and reaction kinetics, respectively. Specifically, an equilibrium S concentration has been obtained based on a sulfide capacity, which is determined by the composition of slag represented by $CaO—SiO_2—Al_2O_3—MgO$-based one, oxygen activity in metal, a S distribution ratio $L_s(-)$ obtained from a temperature, and a slag feed amount. The reaching time has been obtained by a primary reaction formula: $-d[S]/dt=k\cdot(A/V)\cdot([S]-[S]_e)$ relating to desulfurization speed that uses an overall mass transfer coefficient k (m/s), a reaction area A ($m^2$), a molten iron volume V ($m^3$), and the aforementioned equilibrium S concentration $[S]_e$ (mass %).

According to this method, the desulfurization speed is accelerated by the following measures: (1) increasing the ratio of basic oxides in slag; (2) reducing the oxygen activity in molten iron by Al that has a high deoxidation capacity; and (3) increasing the overall mass transfer coefficient k by gas agitation.

However, the slag composition in the current desulfurization process is controlled to be within such a range of composition that the sulfide capacity becomes highest (measure 1). Gas agitation has been improved to the point where problems including reoxidation of molten steel due to scattering of base metal or inclusion of atmospheric air, and picking up of nitrogen are barely tolerable (measure 3). The oxygen activity in molten iron is uniquely determined by the Al concentration and the temperature (measure 2). For these reasons, it is difficult to improve the desulfurization reaction speed more than ever by the conventional improvement methods.

Meanwhile, according to Non-Patent Literature 1, when a slag-metal reaction including the desulfurization reaction is regarded as an electrochemical reaction in which electrons are exchanged at the interface, applying a current voltage to the slag-metal interface from the outside allows further progress of the reaction from an equilibrium concentration that is obtained by the aforementioned sulfide capacity, oxygen activity, temperature, and slag feed amount.

Patent Literature 1 proposes a method that reduces the equilibrium nitrogen concentration by applying a voltage to a slag-metal interface, with electrodes disposed such that one electrode on the molten steel side serves as a negative (cathode) while the other electrode on the slag side serves as a positive (anode).

CITATION LIST

Patent Literature

Patent Literature 1: JP-H04-9420A

Non-Patent Literature

Non-Patent Literature 1: Masanori Tokuda, Bulletin of the Japan Institute of Metals, 15 (1976), p. 379-

Non-Patent Literature 2: D. J. Sosinsky et al., Metall. Trans. B, 17B (1986), p. 331

Non-Patent Literature 3: Takashi Nakamura et al., Bulletin of the Japan Institute of Metals, vol. 50, No. 5 (1986), pp. 456-461

SUMMARY OF INVENTION

Technical Problem

However, the conventional technologies that apply a potential difference between slag and metal as described above have the following problems.

For the technology disclosed in Non-Patent Literature 1, there is no specific mention as to how to control the applied current or the voltage and what effect has been thereby produced. Thus, it is difficult to control the desulfurization reaction based on Non-Patent Literature 1.

The technology disclosed in Patent Literature 1 is a method of controlling the voltage (so-called constant-voltage control). Thus, when the molten iron and the electrode immersed on the slag side come into contact with each other due to fluctuation of the molten metal level that occurs when agitation is involved, a voltage of a few tens of volt is applied to the molten iron that has resistance of nearly 0Ω. As a result, an extremely high current flows through the circuit. Providing facility protection measures, such as wiring, a power source capacity, and a breaker function, for accommodating such a high current would be of an unrealistic scale. As facility damage may occur if such devices cannot be provided, this technology cannot be an operationally practical solution. For performing constant-current control, on the other hand, Patent Literature 1 mentions a current value but does not clarify as to whether the area needed to calculate the current density should be based on the cross-sectional area of the vessel or the electrode immersed in the slag or the metal. In addition, information on the respective areas is also not known. Thus, it is impossible to perform constant-current control based on the information in Patent Literature 1.

Having been contrived in view of these circumstances, the present invention aims to provide a method for efficiently performing a process of desulfurizing molten metal in a short time by effectively increasing the desulfurization speed without passing an excessive current when causing S in the molten metal to move into molten slag by an electrochemical method.

Solution to Problem

As a result of diligently conducting studies in view of the above problems, the present inventor found that an amount of decrease in an equilibrium S concentration $[S]_e$ (mass %)

and an amount of increase in an overall mass transfer coefficient k (m/s) could be quantitatively estimated by the density of a current passed to a circuit. This finding served as a basis for completing the present invention.

A method for desulfurizing molten metal of the present invention that advantageously solves the above-described challenges is a method for desulfurizing molten metal that, using a direct-current power source, applies a potential difference between molten slag and molten metal through electrodes, of which one electrode contacting the molten metal serves as a negative electrode and the other electrode contacting only the molten slag serves as a positive electrode. This method is characterized in that an applied current density $J_a$ is determined according to an equilibrated S concentration $[S]_{e0}$ before application of a potential difference such that an equilibrated S concentration $[S]_{ea}$ when a potential difference is applied becomes equal to or lower than a target S concentration $[S]_{ft}$.

It is considered that the method for desulfurizing molten metal according to the present invention having specifications as follows could be a more preferable solution.

(a) The molten metal is molten iron, and determining the applied current density $J_a$ (A/m$^2$) involves: step 1 of, using Formulae (1) and (2) below, determining a value of A and a value of B based on coefficients listed in Table 1 that are obtained from an equilibrated S concentration $[S]_{e0}$ (mass ppm) before application of a potential difference; and step 2 of, using Formula (3) below, calculating an equilibrated S concentration $[S]_{ea}$ (mass ppm) when a potential difference is applied based on the value of A and the value of B determined in step 1, and determining the applied current density $J_a$ such that the calculated equilibrated S concentration $[S]_{ea}$ becomes equal to or lower than a target S concentration $[S]_{ft}$ (mass ppm).

(b) The applied current density $J_a$ is set to 1000 A/m$^2$ or lower.

$$A=A0+A1\cdot J_a-A2\cdot J_a^2+A3\cdot J_a^3 \quad (1)$$

$$-B=B0+B1\cdot J_a-B2\cdot J_a^2+B3\cdot J_a^3 \quad (2)$$

$$[S]_{ea}=exp(-B/A) \quad (3)$$

TABLE 1

| | | $[S]_{e0}$ | | | | | | | |
|---|---|---|---|---|---|---|---|---|---|
| | | A0 | A1 | A2 | A3 | B0 | B1 | B2 | B3 |
| | | mass ppm | | | | | | | |
| No. | | $\times10^{-2}$ | $\times10^{-4}$ | $\times10^{-7}$ | $\times10^{-10}$ | $\times10^{-1}$ | $\times10^{-4}$ | $\times10^{-7}$ | $\times10^{-11}$ |
| 1 | Exceeding 10 | 6.4408 | 3.6497 | 3.8200 | 1.8218 | 1.1981 | 2.3088 | 1.4831 | 5.2189 |
| 2 | Exceeding 6 but not exceeding 10 | 7.4338 | 3.1714 | 2.9497 | 1.3469 | 1.2493 | 2.1868 | 1.3061 | 4.3146 |
| 3 | Exceeding 5 but not exceeding 6 | 8.1965 | 2.8943 | 2.4923 | 1.1083 | 1.2833 | 2.2380 | 1.5197 | 5.8263 |
| 4 | Exceeding 4 but not exceeding 5 | 10.012 | 2.4337 | 1.8788 | 8.3450 | 1.4139 | 2.0718 | 1.4623 | 6.2218 |
| 5 | Not exceeding 4 | 14.236 | 1.6594 | 0.91710 | 4.0404 | 1.7774 | 1.4833 | 0.79567 | 3.4848 |

Advantageous Effects of Invention

The present invention makes it possible to determine the applied current density according to the slag conditions and the target S concentration. Thus, the equilibrium S concentration can be reduced without an excessive current being applied. Further, an increasing effect on the overall mass transfer coefficient can be achieved, so that when compared with conventional technologies at the same volume of slag, the present invention can efficiently perform a process of desulfurizing molten metal to a lower concentration in a shorter time.

DESCRIPTION OF EMBODIMENT

An embodiment of the present invention will be specifically described below. The drawings are schematic and may differ from the reality. The following embodiment exemplifies a device and a method for embodying the technical idea of the present invention, and is not intended to limit the configuration to the following one. That is, various changes can be made to the technical idea of the present invention within the technical scope described in the claims.

Figure 1A:
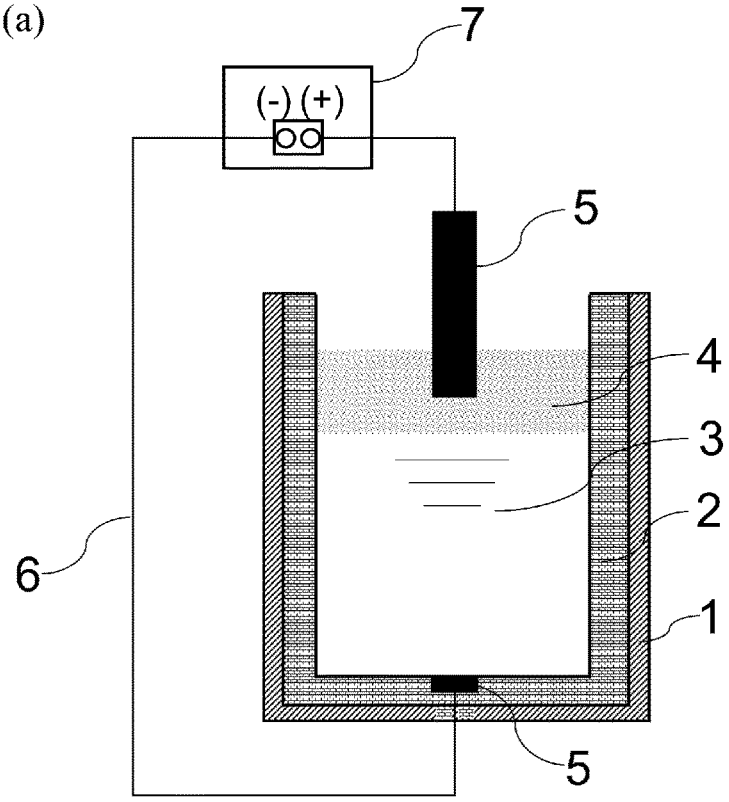
FIG. 1 (*a*) is a schematic view showing one example of devices suitable for a method of the present invention, and FIG. 1 (*b*) is a schematic view showing another example of devices suitable for the method of the present invention.
Figure 1B:
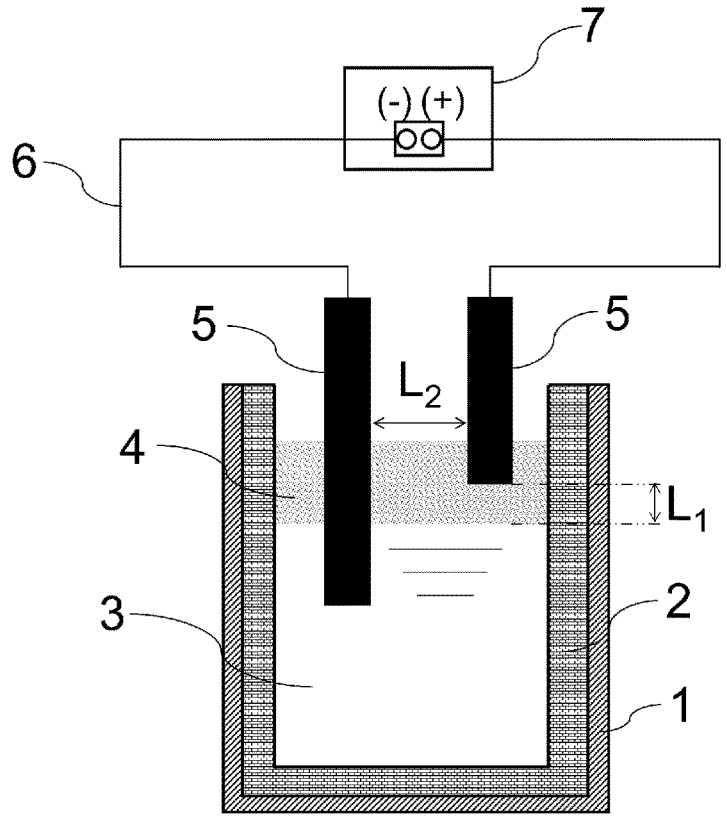

FIG. 1 (*a*) is a schematic view showing one example of devices suitably used for a method for desulfurizing molten metal according to one embodiment of the present invention. Similarly, FIG. 1 (*b*) is a schematic view showing another example of devices suitably used for the method for desulfurizing molten metal. Examples of molten metal include molten iron and copper alloy. In particular, molten iron is preferably used as molten metal. Here, the term "molten iron" refers to melted metal composed mainly of Fe and covers molten pig iron, melted cold iron source, and molten steel. Hereinafter, an embodiment of the present invention will be described using molten iron as an example.

In the device of FIG. 1 (*a*), molten iron 3 is charged into a vessel 1, such as a ladle, that is lined with an insulating refractory 2, and slag 4 is added onto the molten iron 3. Electrically conductive substances 5 are disposed on the side of the slag 4 and the side of the molten iron 3 (in the example of FIG. 1 (*a*), on the furnace bottom), and are connected to a stabilized direct-current power source 7 through lead wires 6. Here, the lead wire 6 connected to the electrically conductive substance 5 disposed on the side of the slag 4 is connected to the plus side (positive electrode) of the stabilized direct-current power source 7. The lead wire 6 connected to the electrically conductive substance 5 disposed on the side of the molten iron 3 is connected to the minus side (negative electrode) of the stabilized direct-current power source 7. While the electrically conductive substance 5 on the side of the molten iron 3 is disposed on the furnace bottom in the example of FIG. 1 (*a*), this electrically conductive substance 5 may instead be disposed on a furnace wall.

As shown in FIG. 1 (*b*), the electrically conductive substance 5 disposed on the side of the molten iron 3 may be partially in contact with the slag 4. In this case, it is necessary to dispose this electrically conductive substance 5 such that a shortest distance L 1 from a leading end of the electrically conductive substance 5 immersed on the side of the slag 4 to a slag-molten iron interface becomes smaller than a shortest distance $L_2$ between surfaces of the electrically conductive substances 5 in the slag 4.

In the device configuration like that of FIG. 1 (*a*) or (*b*), applying a potential difference from the external power source 7 can pass a current between the slag and the molten iron.

In steelmaking, $Al_2O_3$-based bricks or refractories of indefinite shape are often used as the insulating refractory 2. It may be substituted by another refractory that does not have electrical conductivity.

As the electrically conductive substance 5, a graphite shaft or an MgO—C-based refractory can be used. Any other substances that have electrical conductivity and do not melt in a range of molten iron temperature (1300 to 1700° C.) can be used as a substitute.

An injection lance or a bottom-blowing porous plug may be added to the device, and a gas may be blown into the molten iron 3 through it to apply agitation to the molten metal.

Next, a method of determining an applied current density according to this embodiment will be described.

First, an equilibrated S concentration $[S]_{e0}$ (mass ppm) before application of a potential difference in a desulfurization reaction between the slag 4 and the molten iron 3 is obtained. This concentration can be determined based on a sulfide capacity of the slag 4 used as described above, oxygen activity in the molten iron, the temperature, and also the amount of slag 4 used. The calculation method will not be described in detail here, as it is already commonly known from papers etc. and any person skilled in the art can easily perform the calculation. For example, the concentration can be calculated by using the theoretical optical basicity of oxides presented in Non-Patent Literature 3 for the theoretical optical basicity of slag in the formula of a sulfide capacity proposed in Non-Patent Literature 2.

Other than the aforementioned calculation method using the sulfide capacity, a calculation in past operation under similar conditions or an actually measured S distribution ratio Ls=(mass % S)/[mass % S] may be referred to, and the equilibrated S concentration $[S]_{e0}$ (mass ppm) before application of a potential difference may be obtained from this and the amount of slag. Here, (mass % S) and [mass % S] represent a S concentration in the slag and a S concentration in the molten iron, respectively. "Similar conditions" can be selected in terms of the slag composition, the element composition of the molten iron, the processing temperature, etc.

First, as step 1 in determining an applied current density $J_a$ (A/m$^2$), with reference to the value of the equilibrated S concentration $[S]_{e0}$ (mass ppm) before application of a potential difference obtained by the above technique, the coefficients of the following General Formulae (1) and (2) are specified according to the classification of cases below. Then, a formula for determining the value of A and the value of B is determined. Symbol $J_a$ in the formulae denotes the applied current density (A/m$^2$), with $J_a>0$ holding true.

$$A = A0 + A1 \cdot J_a - A2 \cdot J_a^2 + A3 \cdot J_a^3 \quad (1)$$

$$-B = B0 + B1 \cdot J_a - B2 \cdot J_a^2 + B3 \cdot J_a^3 \quad (2)$$

(1) Case where $[S]_{e0}>10$ mass ppm $$A = 6.4408\times10^{-2} + 3.6497\times10^{-4}\cdot J_a - 3.8200\times10^{-7}\cdot J_a^2 + 1.8218\times10^{-10}\cdot J_a^3$$

$$-B = 1.1981\times10^{-1} + 2.3088\times10^{-4}\cdot J_a - 1.4831\times10^{-7}\cdot J_a^2 + 5.2189\times10^{-11}\cdot J_a^3$$

(2) Case where 10 mass ppm$\geq[S]_{e0}>6$ mass ppm $$A = 7.4338\times10^{-2} + 3.1714\times10^{-4}\cdot J_a - 2.9497\times10^{-7}\cdot J_a^2 + 1.3469\times10^{-10}\cdot J_a^3$$

$$-B = 1.2493\times10^{-1} + 2.1868\times10^{-4}\cdot J_a - 1.3061\times10^{-7}\cdot J_a^2 + 4.3146\times10^{-11}\cdot J_a^3$$

(3) Case where 6 mass ppm$\geq[S]_{e0}>5$ mass ppm $$A = 8.1965\times10^{-2} + 2.8943\times10^{-4}\cdot J_a - 2.4923\times10^{-7}\cdot J_a^2 + 1.1083\times10^{-10}\cdot J_a^3$$

$$-B = 1.2833\times10^{-1} + 2.2380\times10^{-4}\cdot J_a - 1.5197\times10^{-7}\cdot J_a^2 + 5.8263\times10^{-11}\cdot J_a^3$$

(4) Case where 5 mass ppm$\geq[S]_{e0}>4$ mass ppm $$A = 1.0012\times10^{-1} + 2.4337\times10^{-4}\cdot J_a - 1.8788\times10^{-7}\cdot J_a^2 + 8.3450\times10^{-10}\cdot J_a^3$$

$$-B = 1.4139\times10^{-1} + 2.0718\times10^{-4}\cdot J_a - 1.4623\times10^{-7}\cdot J_a^2 + 6.2218\times10^{-11}\cdot J_a^3$$

(5) Case where 4 mass ppm$\geq[S]_{e0}$ $$A = 1.4236\times10^{-1} + 1.6594\times10^{-4}\cdot J_a - 9.1710\times10^{-8}\cdot J_a^2 + 4.0404\times10^{-10}\cdot J_a^3$$

$$-B = 1.7774\times10^{-1} + 1.4833\times10^{-4}\cdot J_a - 7.9567\times10^{-8}\cdot J_a^2 + 3.4848\times10^{-11}\cdot J_a^3$$

Figure 2:
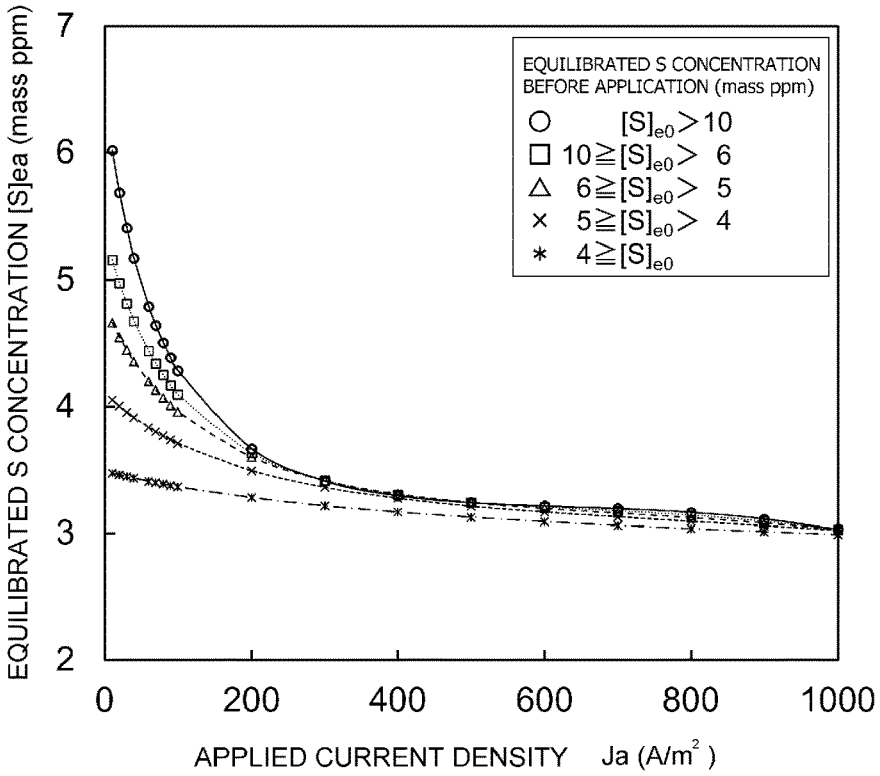
FIG. 2 is a graph showing the influence of an equilibrated S concentration $[S]_{e0}$ before application of a potential difference on a relationship between an applied current density $J_a$ and an equilibrated S concentration $[S]_{ea}$.

Next as step 2, using the value of A and the value of B determined in step 1, an equilibrated S concentration $[S]_{ea}$ (mass ppm) when a potential difference has been applied is calculated by Formula (3) below. FIG. 2 shows the applied current density $J_a$ (A/m$^2$) on the axis of abscissas and the equilibrated S concentration $[S]_{ea}$ (mass ppm) on the axis of ordinates, as plotted according to the above-described classification of cases. From FIG. 2, the applied current density $J_a$ and the corresponding equilibrated S concentration $[S]_{ea}$ can be obtained.

$$[S]_{ea} = \exp(-B/A) \tag{3}$$

Using FIG. 2, one can obtain, for the equilibrated S concentration $[S]_{e0}$ before application of a potential difference, information on a minimum applied current density $J_a$ required for making the equilibrated S concentration $[S]_{ea}$ when a potential difference is applied equal to or lower than a target S concentration $[S]_{ft}$ upon completion of the desulfurization process. It is preferable that the equilibrated S concentration $[S]_{ea}$ when a potential difference is applied be made lower than the target S concentration $[S]_{ft}$ upon completion of the desulfurization process.

For example, in the case where the equilibrated S concentration $[S]_{e0}$ before application of a potential difference is 8 mass ppm and the target S concentration $[S]_{ft}$ upon completion of the process is desired to be 5 mass ppm, from the result of the calculation using the determination formula (2), the applied current density $J_a$ can be estimated to be about 20 A/m$^2$ or higher.

Since the desulfurization speed is defined by $-d[S]/dt=k\cdot(A/V)([S]-[S]_e)$ as described above, other than lowering the equilibrated S concentration $[S]_e$, increasing the overall mass transfer coefficient k can also increase the desulfurization speed.

Figure 3:
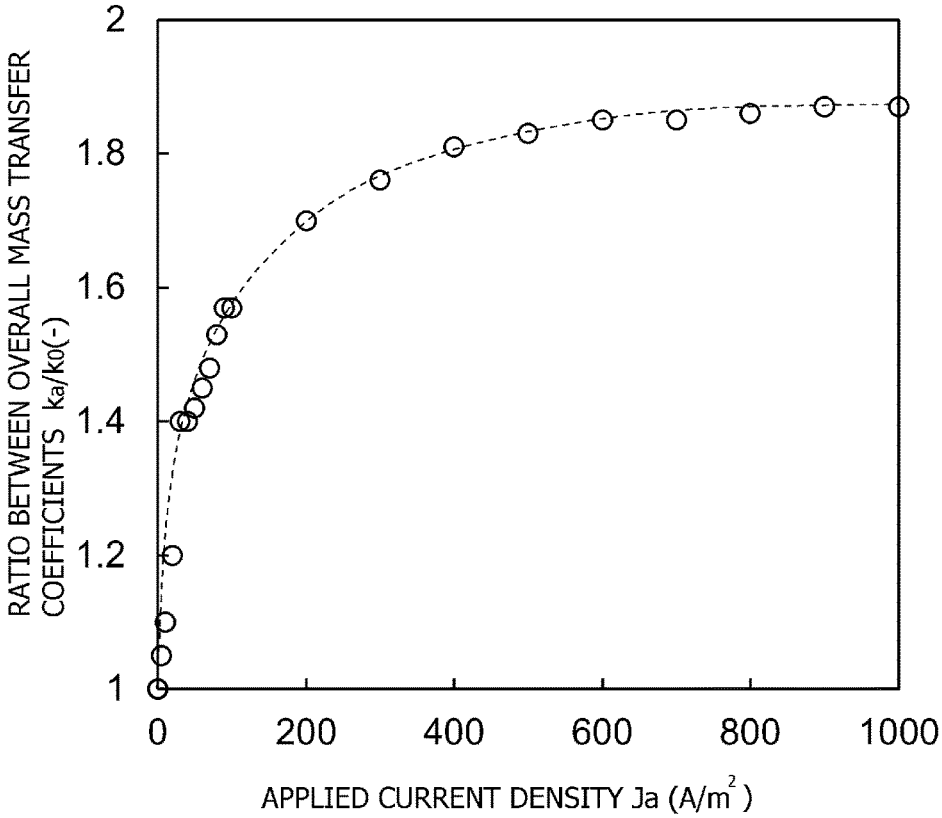
FIG. 3 is a graph showing a relationship between an overall mass transfer coefficient k of S between slag and molten iron and the applied current density $J_a$.

When an overall mass transfer coefficient $k_a$(m/s) when a potential difference has been applied and an overall mass transfer coefficient $k_0$(m/s) before application of a potential difference were compared, it was found that the ratio $k_a/k_0$ (−) between these overall mass transfer coefficients had dependency on the applied current density $J_a$ as shown in FIG. 3.

From FIG. 3, the inclination of the increasing rate of the overall mass transfer coefficient is small at an applied current density $J_a$ exceeding 1000 A/m$^2$. Thus, when 1000 A/m$^2$ is exceeded, increasing the applied current density $J_a$ cannot be expected to have an increasing effect on the overall mass transfer coefficient. It is therefore preferable that the applied current density $J_a$ be set to 1000 A/m$^2$ or lower.

When calculating an amount of current $I_a$ (A)=$J_a\times$A to be passed to the circuit from the applied current density $J_a$ (A/m$^2$) obtained as described above, it is preferable that an area of contact (m$^2$) between slag and molten iron charged in a vessel be used as the area A. In reality, however, the accurate area of contact is often unknown due to agitation applied to the molten iron etc. Therefore, it is also acceptable to use for the calculation an inner cross-sectional area (m$^2$) of the device at the position of the slag-molten iron interface that takes the insulating refractory 2 lining the vessel 1 into account. This is because the slag 4 itself behaves as a positive electrode (anode) and the molten iron 3 itself behaves as a negative electrode (cathode) through the electrically conductive substances. The present inventor has confirmed that changing the ratio between the cross-sectional areas of leading end portions of the respective electrically conductive substances 5 on the side of the slag 4 and on the side of the molten iron 3 did not affect the S concentration reached or the desulfurization speed.

EXAMPLES

In the following, examples of the present invention will be described in detail.

Using a device having the configuration of FIG. 1 (*a*), CaO—$Al_2O_3$ binary slag, CaO—$Al_2O_3$—MgO ternary slag, or CaO—$Al_2O_3$—$SiO_2$—MgO quaternary slag was added onto molten iron of 1400° C. to 1650° C. In the slag, a lead wire was connected to a plus electrode (positive electrode) of an external power source through a graphite shaft, and in the molten iron, a lead wire was connected to a minus electrode (negative electrode) of the external power source through an MgO—C brick, and a current was passed to the circuit by a constant-current application method using a stabilized direct-current power source.

The slag composition, the oxygen activity in the molten iron, the temperature, and the slag feed amount were adjusted such that the equilibrated S concentration $[S]_{e0}$ before application of a potential difference assumed the following five levels: 11.0, 8.0, 5.5, 4.5, and 3.8 mass ppm.

For the applied current density $J_a$ (A/m$^2$), the value of A and the value of B were obtained from the above-described determination formulae (1) to (5), and an applied current density $J_{min}$ (A/m$^2$) at which the equilibrated S concentration $[S]_{ea}$ when a potential difference is applied meets the target S concentration $[S]_{ft}$ upon completion of the process was obtained by the above-described steps 1 and 2. A current was passed from the stabilized direct-current power source with the applied current density $J_a$ set according to the following three patterns: (a) lower than the obtained value $J_{min}$; (b) not lower than the obtained value $J_{min}$ and not higher than 1000 A/m$^2$; and (c) higher than 1000 A/m$^2$.

For the current to be passed, a value obtained as the product of the cross-sectional area A (m$^2$) of the device at an upper end of the part where the molten iron was charged and the applied current density $J_a$ (A/m$^2$) was used as a set current value $I_a$ (A) of the stabilized direct-current power source, and this current was maintained for the duration of a desulfurization process time ta (min).

Tests were conducted within a range of 0.018 to 18 m$^2$ of the cross-sectional area A of the device at the upper end of the part where the molten iron was charged, and a range of 6.8 kg to 280 t of the amount of molten iron. Table 2 shows test conditions and results. In the column "Judgment", circles are indicated for those tests in which the S concentration $[S]_{fa}$ reached was not higher than the target S concentration $[S]_{ft}$, and crosses are indicated for those tests in which the S concentration $[S]_{fa}$ reached was higher than the target S concentration $[S]_{ft}$. Table 2 also lists the equilibrated S concentration $[S]_{ea}$ when a potential difference is applied, the ratio $k_a/k_0$ (−) between the overall mass transfer coefficients in desulfurization, the process time ta, and the desulfurization speed −d[S]/dt (mass ppm/min). Here, for the process time ta, the equilibrated S concentration $[S]_{ea}$ when a potential difference is applied and the overall mass transfer coefficient k a were substituted for the values in the linear formula (shown above) of temporal changes in S concentration [S] relating to the desulfurization reaction to thereby predict changes in S concentration [S] over time. A time with which the S concentration $[S]_{fa}$ reached became lower than a value obtained by adding 0.5 mass ppm to the equilibrated S concentration $[S]_{ea}$ was predicted, and that time was used as the process time ta.

TABLE 2

| No. | $[S]_{e0}$ mass ppm | $[S]_{ft}$ mass ppm | $J_{min}$ A/m$^2$ | $J_a$ A/m$^2$ | $[S]_{fa}$ mass ppm | $[S]_{ea}$ mass ppm | Judgement | $k_a/k_0$ — | ta min | -d[S]/dt mass ppm/min | Remarks |
|---|---|---|---|---|---|---|---|---|---|---|---|
| 1 | 11.0 | 6.4 | 10 | 0 | 11.4 | 11.0 | × | 1 | 80 | 0.61 | Comparative Example |
| 2 | 11.0 | 6.4 | 10 | 5 | 6.6 | 6.2 | × | 1.05 | 73 | 0.71 | Comparative Example |
| 3 | 11.0 | 6.4 | 10 | 10 | 6.3 | 6.0 | ○ | 1.10 | 66 | 0.81 | Invention Example |
| 4 | 11.0 | 6.4 | 10 | 60 | 5.2 | 4.8 | ○ | 1.45 | 49 | 1.12 | Invention Example |
| 5 | 11.0 | 6.4 | 10 | 100 | 4.4 | 4.3 | ○ | 1.57 | 44 | 1.27 | Invention Example |
| 6 | 11.0 | 6.4 | 10 | 600 | 3.9 | 3.2 | ○ | 1.85 | 36 | 1.54 | Invention Example |
| 7 | 11.0 | 6.4 | 10 | 1000 | 3.4 | 3.0 | ○ | 1.87 | 35 | 1.60 | Invention Example |
| 8 | 11.0 | 6.4 | 10 | 1200 | 3.4 | 2.8 | ○ | 1.87 | 35 | 1.61 | Invention Example |
| 9 | 8.0 | 4.4 | 100 | 0 | 8.4 | 8.0 | × | 1 | 80 | 0.65 | Comparative Example |
| 10 | 8.0 | 4.4 | 100 | 90 | 4.6 | 4.2 | × | 1.57 | 48 | 1.14 | Comparative Example |
| 11 | 8.0 | 4.4 | 100 | 100 | 4.4 | 4.1 | ○ | 1.57 | 46 | 1.21 | Invention Example |
| 12 | 8.0 | 4.4 | 100 | 300 | 3.9 | 3.4 | ○ | 1.76 | 40 | 1.40 | Invention Example |
| 13 | 8.0 | 4.4 | 100 | 1000 | 3.4 | 3.0 | ○ | 1.87 | 37 | 1.53 | Invention Example |
| 14 | 8.0 | 4.4 | 100 | 1100 | 3.4 | 2.9 | ○ | 1.87 | 37 | 1.53 | Invention Example |
| 15 | 5.5 | 4.4 | 90 | 0 | 5.9 | 5.5 | × | 1 | 80 | 0.68 | Comparative Example |
| 16 | 5.5 | 4.4 | 90 | 80 | 4.6 | 4.1 | × | 1.53 | 51 | 1.08 | Comparative Example |
| 17 | 5.5 | 4.4 | 90 | 100 | 4.4 | 4.0 | ○ | 1.59 | 48 | 1.16 | Invention Example |
| 18 | 5.5 | 4.4 | 90 | 500 | 3.7 | 3.2 | ○ | 1.83 | 41 | 1.39 | Invention Example |
| 19 | 4.5 | 4.4 | 20 | 0 | 4.9 | 4.5 | × | 1 | 80 | 0.69 | Comparative Example |
| 20 | 4.5 | 4.4 | 20 | 10 | 4.6 | 4.1 | × | 1.10 | 72 | 0.77 | Comparative Example |
| 21 | 4.5 | 4.4 | 20 | 20 | 4.4 | 4.0 | ○ | 1.20 | 66 | 0.85 | Invention Example |
| 22 | 4.5 | 4.4 | 20 | 400 | 3.7 | 3.3 | ○ | 1.81 | 42 | 1.33 | Invention Example |
| 23 | 3.8 | 3.4 | 500 | 0 | 4.2 | 3.8 | × | 1 | 80 | 0.70 | Comparative Example |
| 24 | 3.8 | 3.4 | 500 | 400 | 3.6 | 3.2 | × | 1.80 | 43 | 1.30 | Comparative Example |
| 25 | 3.8 | 3.4 | 500 | 500 | 3.4 | 3.1 | ○ | 1.82 | 42 | 1.33 | Invention Example |
| 26 | 3.8 | 3.4 | 500 | 700 | 3.4 | 3.1 | ○ | 1.85 | 42 | 1.35 | Invention Example |
| 27 | 3.8 | 3.4 | 500 | 900 | 3.4 | 3.0 | ○ | 1.87 | 41 | 1.37 | Invention Example |

At each of the levels, in tests in which the minimum required applied current density $J_{min}$ was not met (No. 2, 10, 16, 20, and 24), the S concentration $[S]_{fa}$ reached with the same process time was lower than that in tests in which no current was passed (No. 1, 9, 15, 19, and 23), but failed to achieve the target S concentration $[S]_{ft}$. On the other hand, in tests in which a current with a density not lower than the minimum required applied current density $L_{min}$ (No. 3 to 8, 11 to 14, 17, 18, 20, 21, and 25 to 27) was passed, the S concentration $[S]_{fa}$ reached was reduced to the target S concentration $[S]_{ft}$ or lower.

In tests in which a current was passed at an applied current density higher than 1000 A/m$^2$ (No. 8 and 14), both the S concentration $[S]_{fa}$ reached and the process time to were equivalent to those in tests in which a current was passed at an applied current density of 1000 A/m$^2$ (No. 7 and 13). This demonstrates that passing a current at a current density exceeding 1000 A/m$^2$ does not significantly affect at least the S concentration reached and the desulfurization reaction speed.

INDUSTRIAL APPLICABILITY

The present invention can reduce the S concentration reached per fixed process time while keeping power consumption down, and can achieve a reduction in the production cost. The present invention is suitably applied not only to desulfurization of molten metal but also to refining in which an electrochemical reaction at an interface is dominant.

REFERENCE SIGNS LIST

1 Vessel
2 (Insulating) refractory
3 Molten iron
4 Slag
5 Electrically conductive substance
6 Lead wire
7 Stabilized direct-current power source

The invention claimed is:

1. A method for desulfurizing molten metal that, using a direct-current power source, applies a potential difference between molten slag and molten metal through electrodes, of which one electrode contacting the molten metal serves as a negative electrode and the other electrode contacting only the molten slag serves as a positive electrode, characterized in that an applied current density $J_a$ is determined according to an equilibrated S concentration $[S]_{e0}$ before application of a potential difference such that an equilibrated S concentration $[S]_{ea}$ when a potential difference is applied becomes equal to or lower than a target S concentration $[S]_{ft}$, wherein the applied current density $J_a$ is set to 1000 A/m$^2$ or lower.

2. The method for desulfurizing molten metal according to claim 1, wherein the molten metal is molten iron, and wherein determining the applied current density $J_a$ (A/m$^2$) involves:

step 1 of, using Formulae (1) and (2) below, determining a value of A and a value of B based on coefficients that are obtained from an equilibrated S concentration $[S]_{e0}$ (mass ppm) before application of a potential difference; and step 2 of, using Formula (3) below, calculating an equilibrated S concentration $[S]_{ea}$ (mass ppm) when a potential difference is applied based on the value of A and the value of B determined in step 1, and determining the applied current density $J_a$ such that the calculated equilibrated S concentration $[S]_{ea}$ becomes equal to or lower than a target S concentration $[S]_{ft}$ (mass ppm):

$$A = A0 + A1 \cdot J_a - A2 \cdot J_a^2 + A3 \cdot J_a^3 \quad (1)$$

$$-B = B0 + B1 \cdot J_a - B2 \cdot J_a^2 + B3 \cdot J_a^3 \quad (2)$$

$$[S]_{ea} = \exp(-B/A). \quad (3)$$

* * * * *